US007810908B2

(12) United States Patent
Chikamoto et al.

(10) Patent No.: US 7,810,908 B2
(45) Date of Patent: Oct. 12, 2010

(54) INK-JET HEAD

(75) Inventors: Tadanobu Chikamoto, Nagoya (JP); Hiroshi Taira, Ichinomiya (JP); Yoshirou Kita, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 867 days.

(21) Appl. No.: 11/692,704

(22) Filed: Mar. 28, 2007

(65) Prior Publication Data

US 2007/0229596 A1 Oct. 4, 2007

(30) Foreign Application Priority Data

Mar. 31, 2006 (JP) ..... 2006-100475

(51) Int. Cl.
*B41J 2/14* (2006.01)
*B41J 2/16* (2006.01)

(52) U.S. Cl. ..... 347/50; 347/58

(58) Field of Classification Search ..... 347/40, 347/50, 58

See application file for complete search history.

(56) References Cited

U.S. PATENT DOCUMENTS

| | | | | |
|---|---|---|---|---|
| 7,061,449 | B2 | 6/2006 | Oya et al. | |
| 2004/0119787 | A1 * | 6/2004 | Mori | 347/57 |
| 2005/0057613 | A1 | 3/2005 | Watanabe | |
| 2005/0141710 | A1 | 6/2005 | Mashitani | |

FOREIGN PATENT DOCUMENTS

| | | |
|---|---|---|
| JP | 2002281124 | 9/2002 |
| JP | 2003087363 | 3/2003 |
| JP | 2005059339 | 3/2005 |
| JP | 2005189455 | 7/2005 |

* cited by examiner

*Primary Examiner*—Thinh H Nguyen
(74) *Attorney, Agent, or Firm*—Baker Botts L.L.P.

(57) ABSTRACT

The confronting area of flexible printed circuit is interposed between the leading face and the passage unit. A protruding length of the protrusion region from the spaced face is equal or larger than that of the fixed region. A recess is formed on the support face of the passage unit at a position confronting the leading face. Both ends of the leading face are interposed between both ends of the opening of the recess with respect to a draw-out direction. The confronting area of the flexible printed circuit passes through the recess.

9 Claims, 13 Drawing Sheets

INK-JET HEAD

CROSS-REFERENCE TO RELATED APPLICATIONS

This application claims the benefit of Japanese Patent Application No. 2006-100475, filed Mar. 31, 2006, the disclosure of which is incorporated herein by reference.

BACKGROUND OF THE INVENTION

1. Field of the Invention

The present invention relates to an ink-jet head for discharging ink onto a recording medium.

2. Description of the Prior Art

Japanese Patent Unexamined Publication No. 2005-59339 discloses an ink-jet head that includes a head main body including a passage unit, in which ink passages are formed, and several actuator units adhered on the upper face of the passage unit. In the ink-jet head, an adhesive is applied to the end of the passage unit in a sub scanning direction where the actuator units are not adhered. Many individual electrodes are disposed on the upper faces of the actuator units, and are electrically connected with many signal lines, respectively, of a flexible printed circuit (FPC). The FPC is fixed to the passage unit 4 with an adhesive. A recess or a protrusion is formed on the upper face of the passage unit between the adhesive and the actuator units so as to prevent the adhesive from flowing to the actuator units.

SUMMARY OF THE INVENTION

In such an ink-jet head, the FPC is partially adhered on the upper face of the passage unit 4 by the adhesive applied to the end of the passage unit in a sub scanning direction. Then, when the FPC is applied with a tensile force, a force peeling off the FPC from the passage unit is applied to an adhering area between the FPC and the passage unit. Herein, when the peeling force exceeds the adhering force of the adhesive, the FPC is peeled off from the passage unit, and furthermore, the peeling force is applied on the connection area between the signal lines and the individual electrodes. Such force affecting the connection area between the signal lines and the individual electrodes acts in a direction that the FPC and the actuator unit become far away from each other, so that the electrical connection between the signal lines and the individual electrodes is easily cut off.

Accordingly, an object of the present invention is to provide an ink-jet head in which the connection between wirings and individual electrodes is hardly disconnected.

In accordance with a first aspect of the present invention, an ink-jet head includes a passage unit, an actuator unit, a flexible printed circuit, and a covering. The passage unit has a plurality of pressure chambers arranged along a plane and communicating with a plurality of ink ejection ports that are formed on an ink discharging face. The actuator unit is supported by a support face of the passage unit opposite to the ink discharging face. And the actuator unit has a plurality of individual electrodes each confronting the pressure chambers, and that changes in volume of the pressure chambers. The flexible printed circuit has a plurality of wirings which supply driving signals to the individual electrodes. And the flexible printed circuit is provided with a connection area and a confronting area. In the connection area, the respective wirings are electrically connected with corresponding individual electrodes. And the connection area confronts the actuator unit. The confronting area is continuous with the connection area and confronting not the actuator unit but the passage unit. The covering includes a spaced region, a fixed region, and a protrusion region. The spaced region has a spaced face spaced apart from the connection area with respect to a direction perpendicular to the ink discharging face. The fixed region has a fixed face that protrudes toward the passage unit from the spaced face and is fixed to the support face as well. The protrusion region has a leading face that protrudes toward the passage unit from the spaced face. And the confronting area is interposed between the leading face and the passage unit. A protruding length of the protrusion region from the spaced face is equal or larger than that of the fixed region. A recess is formed on the support face of the passage unit at a position confronting the leading face. Both ends of the leading face are interposed between both ends of the opening of the recess with respect to a draw-out direction that is parallel to the support face and is toward the confronting area from the connection area. The protrusion region is spaced apart from an inner face of the recess. The confronting area of the flexible printed circuit passes through the recess.

According to the first aspect of the invention, the confronting area of the flexible printed circuit drawn out from the actuator unit passes between the leading face of the protrusion region and the inner face of the recess. Thus, even when an external force in a direction of drawing the flexible printed circuit is applied to the flexible printed circuit, the confronting area is drawn in a direction of approaching the support face, so that, in the flexible printed circuit, a force is hardly applied to the connection area in a direction away from the actuator unit. Accordingly, the connection between the wirings and the individual electrodes is hardly disconnected from each other.

BRIEF DESCRIPTION OF THE DRAWINGS

Other and further objects, features and advantages of the present invention will appear more fully from the following description taken in connection with the accompanying drawings, in which.

DESCRIPTION OF THE PREFERRED EMBODIMENTS

Hereinafter, preferred embodiments of the present invention will be described with reference to the accompanying drawings.

Figure 1:
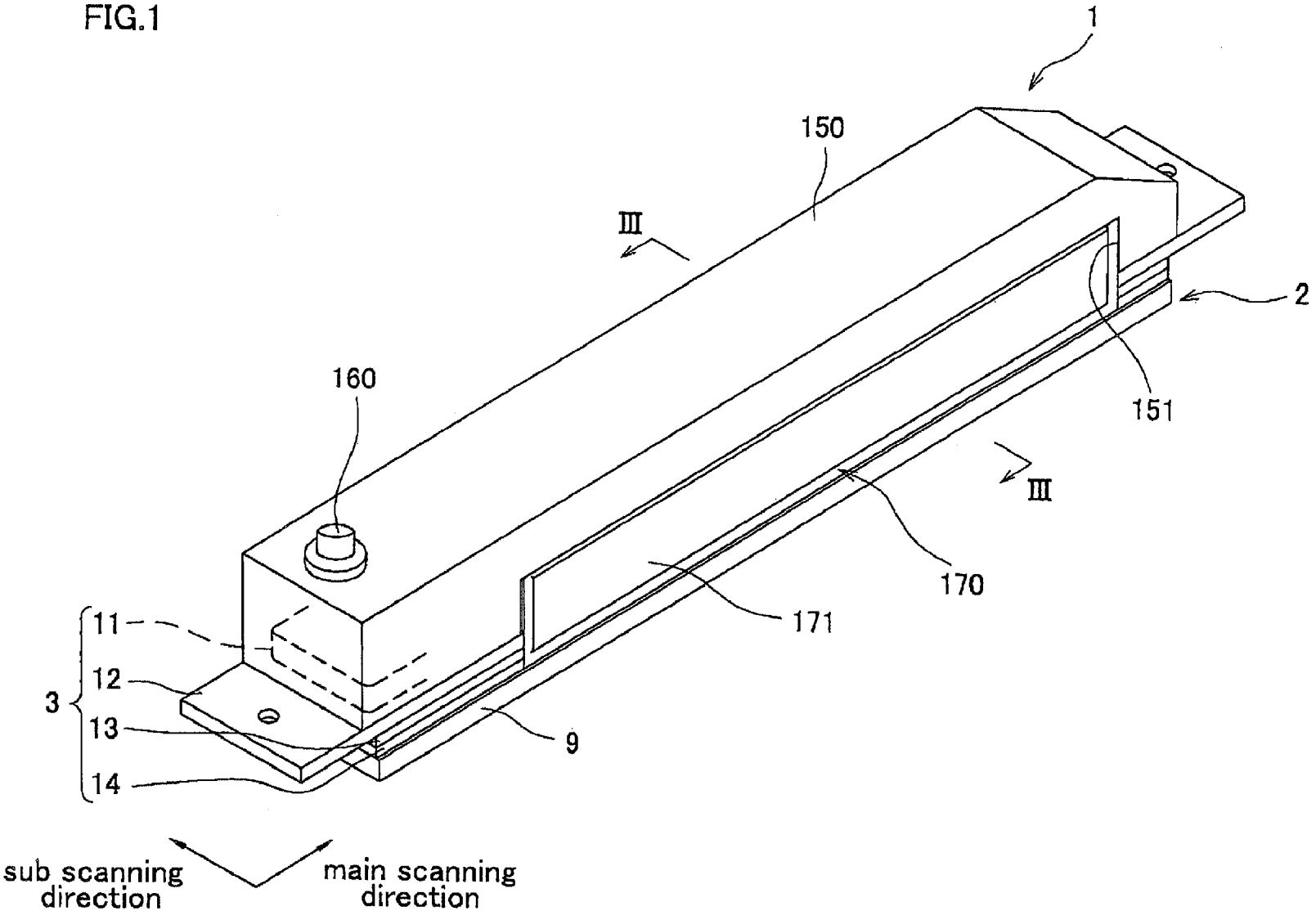
FIG. 1 is a schematic perspective view of an ink-jet head according to a first embodiment of the present invention.

FIG. 1 is a schematic perspective view of an ink-jet head 1 according to a first embodiment of the present invention. As shown in FIG. 1, the ink-jet head 1 has a shape elongated in a main scanning direction, i.e., a longitudinal direction. The ink-jet head 1 has a head main body 2 and a reservoir unit 3 supplying ink to the head main body 2. The reservoir unit 3 has a passage component 11 and three plates 12 to 14. The passage component 11, the plates 12 to 14, and the head main body 2 are shaped like a rectangle in plan view, a long side of which is in parallel with the main scanning direction. The passage component 11, the plates 12 to 14, and the head main body 2 are laminated in order from upside to downside.

The ink-jet head 1 has a head cover 150. The head cover 150 is shaped like a box opening downward. The head cover 150 is installed over the plate 12 to cover the parts, such as the passage component 11 installed on the plate 12. The head cover 150 is provided, at its upper face, with a through-hole, through which an upper section of an ink supply valve 160 protrudes. Ink is supplied via the ink supply valve 160 to an ink passage 34 formed in the reservoir unit 3. The ink passage 34 will be described later.

The head cover 150 is provided with openings 151 at sides opposite to each other with respect to a sub scanning direction, i.e., a width direction of the head cover. The opening 151 is a cut-out in which the side of the head cover 150 is cut out from a lower end of the side to the middle of the side along an up/down direction of the head cover 150. The opening 151 is shaped like a rectangle, a long side of which is parallel with a main scanning direction. In addition, the short side of the opening 151 is parallel with an up/down direction. In the side of the ink-jet head 1, a heat sink 170 to be described later is installed in the head cover 150. In this embodiment, a flat projection 171 is exposed outside from the head cover 150 through the opening 151. In the ink-jet head 1, respective gaps between the head cover 150, the heat sink 170, the plate 12, and the head main body 2 are filled with a sealing material (not shown) such that spaces defined by them become closed.

The ink-jet head 1 is adapted to all of text and image recording devices that employ an ink-jet type, such as an ink-jet printer. For example, in the case that the ink-jet head 1 is adapted to the ink-jet printer, as viewed from upside, the ink-jet head 1 is disposed such that longitudinal/width directions thereof follow main/sub scanning directions, respectively. When paper is carried to a position confronting to a nozzle (ink ejection port) 108, which will be described later, formed on the lower face of the head main body 2, ink is discharged from the nozzle 108 to thereby form texts and images on the paper. Ink used in the ink-jet head 1 is supplied, for example, from an ink cartridge installed in an ink-jet printer via an ink tube (not shown) connected to an ink supply valve 160.

Figure 2:
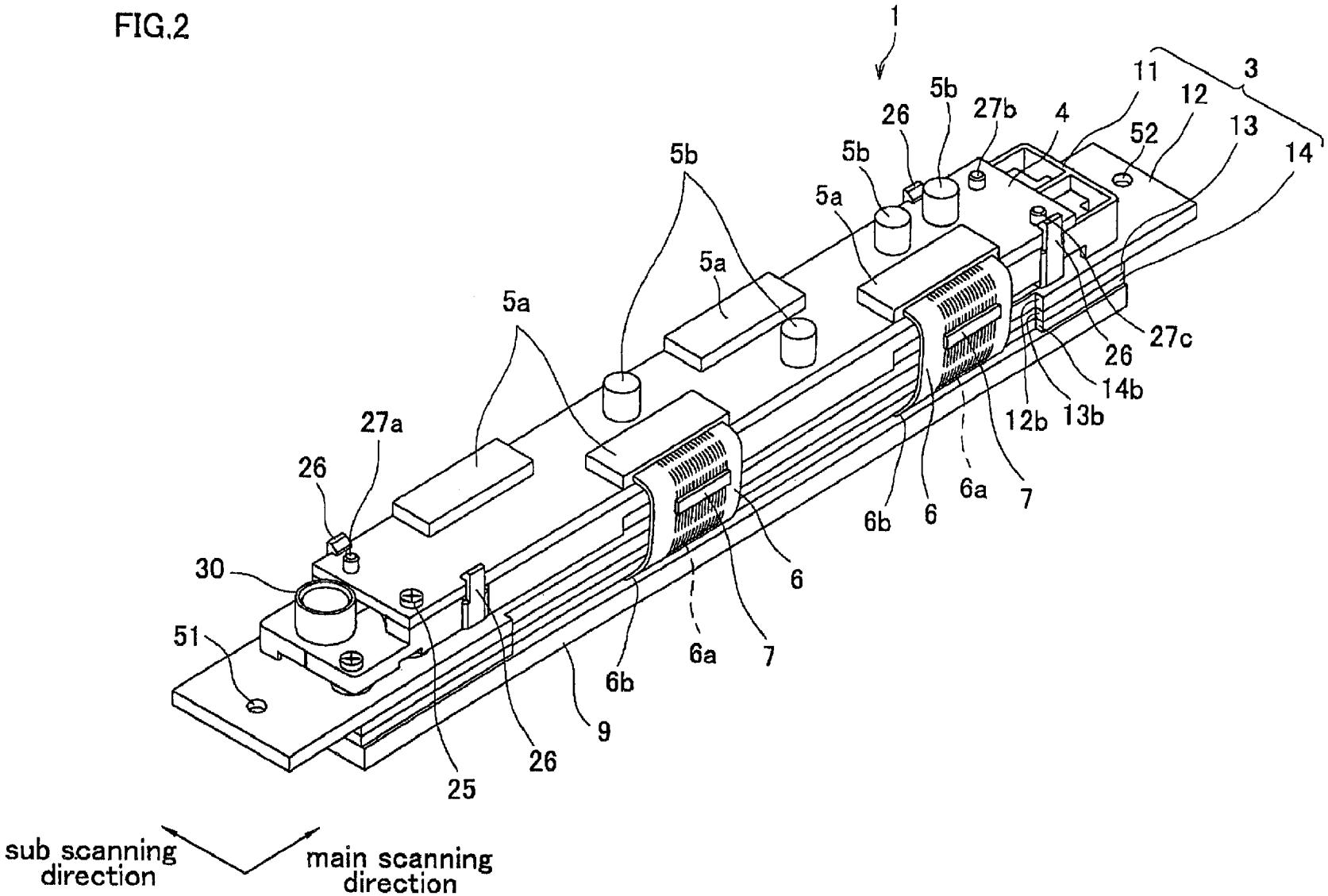
FIG. 2 is a perspective view of the internal construction of the ink-jet head illustrated in FIG. 1.
Figure 3:
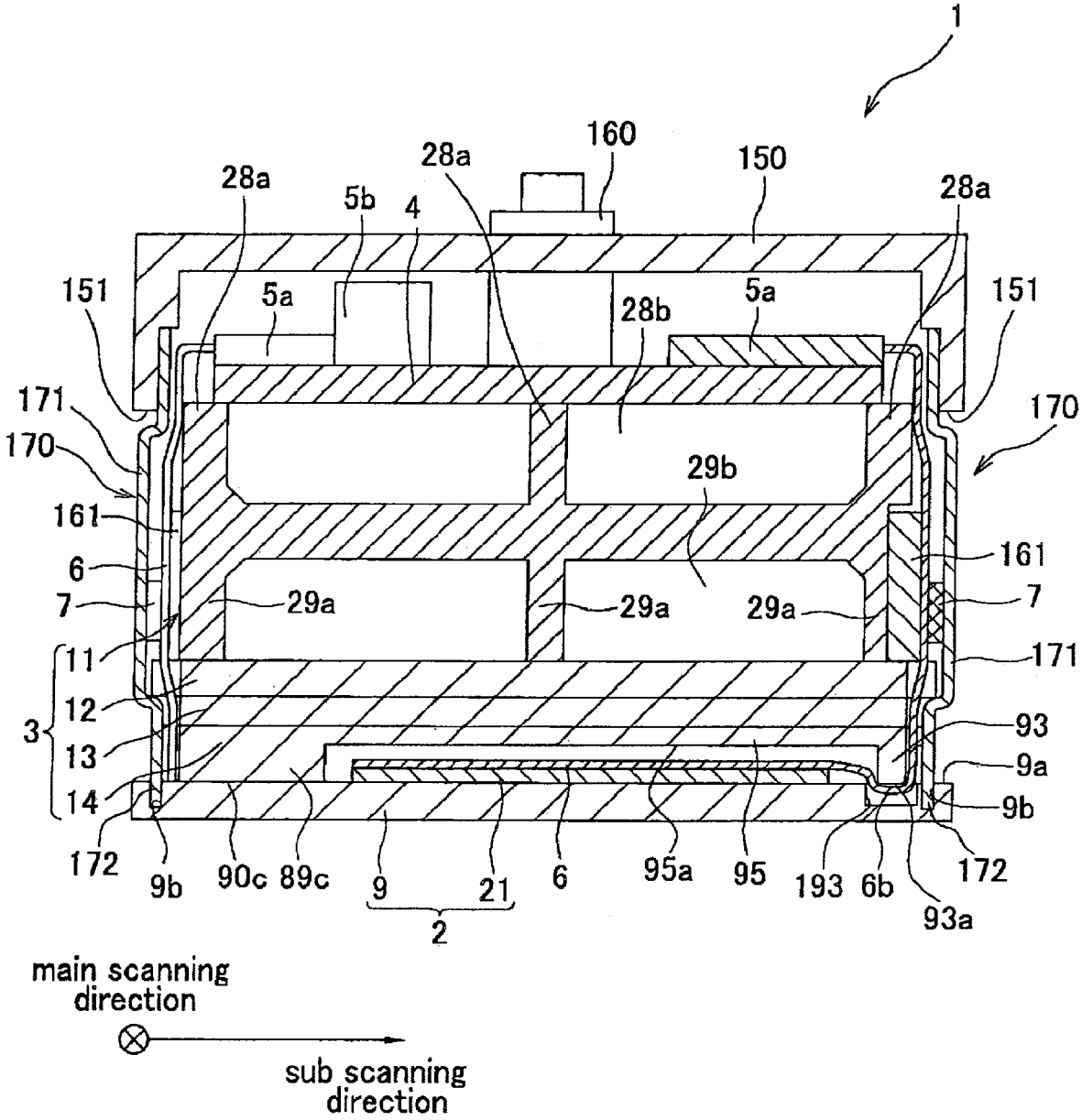
FIG. 3 is a sectional view taken along lines III-III in FIG. 1.

FIG. 2 is a perspective view of the ink-jet head 1 in which the head cover 150 and the heat sink 170 are removed. FIG. 3 is a sectional view taken along lines III-III illustrated in FIG. 1. As illustrated in FIGS. 2 and 3, a board (circuit board) 4 is fixed on the reservoir unit 3. On the upper face of the board 4, four connectors 5*a* and four capacitors 5*b* are installed. Four connectors 5*a* are arranged in zigzags along the main scanning direction.

As illustrated in FIG. 3, the head main body 2 includes a passage unit 9 and four actuator units 21 supported on the upper face 9*a* as a support face of the passage unit 9. The actuator unit 21 includes a number of actuators installed confronting to a number of pressure chambers 110 to be described later, and has a function of providing ink in the pressure chambers 110 formed in the passage unit 9 with ejection energy.

A flexible printed circuit (FPC) 6 as a power supply member is attached to each upper face of the actuator units 21. As illustrated in FIG. 3, the FPC 6 is drawn in the right side between the actuator unit 21 and the reservoir unit 3, and then is drawn upward through an interspace between the reservoir unit 3 and the heat sink 170. The FPC 6 is electrically provided such that one end thereof is connected to the actuator unit 21 and the other end thereof to the connector 5*a*. As illustrated in FIG. 2, in the FPC 6, a number of wirings 6*a* are arranged in an extension direction of the FPC 6. A driver IC 7 is installed on the FPC between the actuator unit 21 and the board 4. That is, the FPC 6 provides electrical connections between the board 4 and the driver IC 7, and electrical connections between the driver IC 7 and the actuator unit 21 by using the wirings 6*a*. And the FPC 6 transmits image signals output from the board 4 to the driver IC 7, and selectively supplies driving signals output from the driver IC 7 to a number of actuators of the respective actuator units 21.

As illustrated in FIG. 3, the driver IC 7 is biased toward the heat sink 170 together with the FPC 6, by an elastic member 161 installed to the side of the passage component 11 with respect to the position confronting to the heat sink 170. Thus, the driver IC 7 comes into contact with the heat sink 170, so that heat transferred from heating driver IC 7 radiates outside through the heat sink 170, thereby the driver IC 7 is cooled.

As shown in FIG. 3, the heat sinks 170 are so installed as to stand at both ends in the sub scanning direction of the passage unit 9, such that the reservoir unit 3 is interposed between them, and the heat sinks 170 protrude from the upper face 9*a*. The two plates of heat sinks 170 are made of, for example, aluminum metal, and are shaped like a rectangle, a longitudinal direction of which is the main scanning direction The heat sink 170 has a flat protrusion 171 and five projections 172. The flat protrusion 171 is provided to the section of the heat sink 170 confronting the side face of the passage component 11, so that it protrudes outside from the opening 151. The protruding part, i.e., the leading part, of the flat protrusion 171 is a flat section shaped as a rectangle, a longitudinal direction of which is the main scanning direction. The flat protrusion 171 is formed, for example, by implementing a press machining to a metallic flat plate. With the formation of flat protrusion 171, the heat sink 170 is increased in its rigidity.

The projections 172 protrude downward from the lower end of the heat sink 170. Five projections are provided along the main scanning direction. Herein, a width of the upper face 9*a* of the passage unit 9 is larger than a width of the reservoir unit 3. The reservoir unit 3 is positioned at the center in the sub scanning direction. Thus, in the vicinity of both ends of the passage unit 9 in the sub scanning direction, there are areas that do not confront the lower face of the reservoir unit 3. In these areas, five recesses 9*b* are provided (See FIG. 8). These recesses 9*b* have a size and a shape to which the projections 172 of the heat sinks 170 are suitably fitted. With fitting of projections 172 into the recesses 9*b*, the heat sinks 170 are installed to stand from the passage unit 9.

Figure 4:
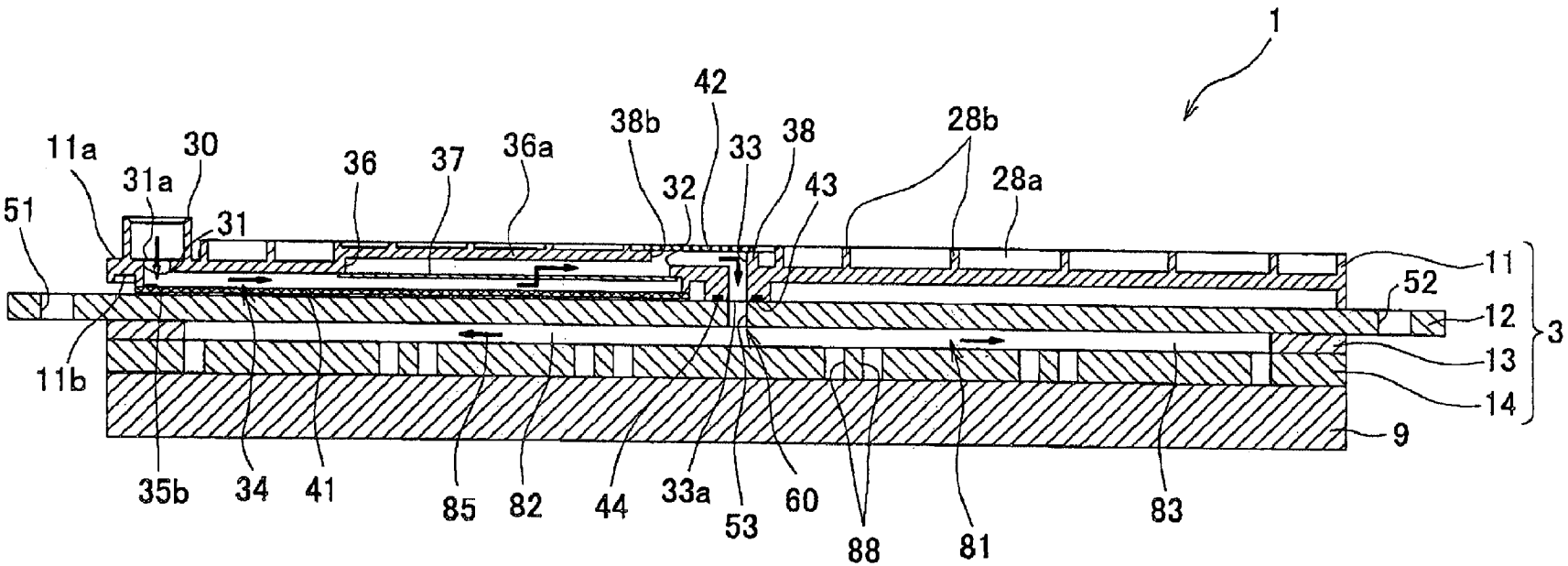
FIG. 4 is a cross-sectional view of a reservoir unit.
Figure 5A:
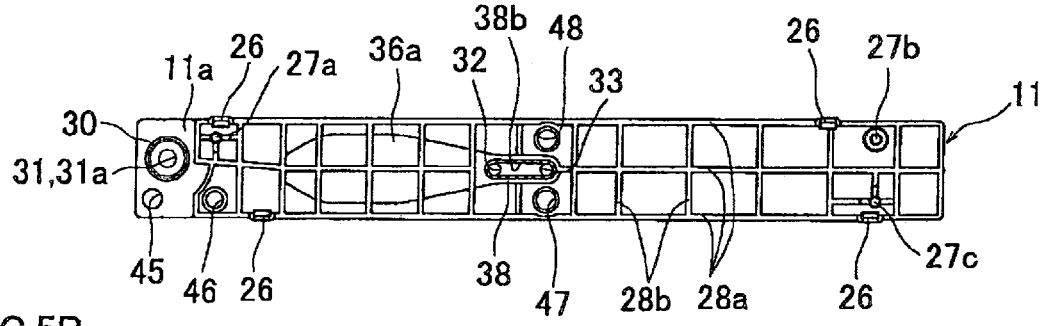
FIG. 5 is an exploded plan view of the reservoir unit illustrated in FIG. 2.
Figure 5B:
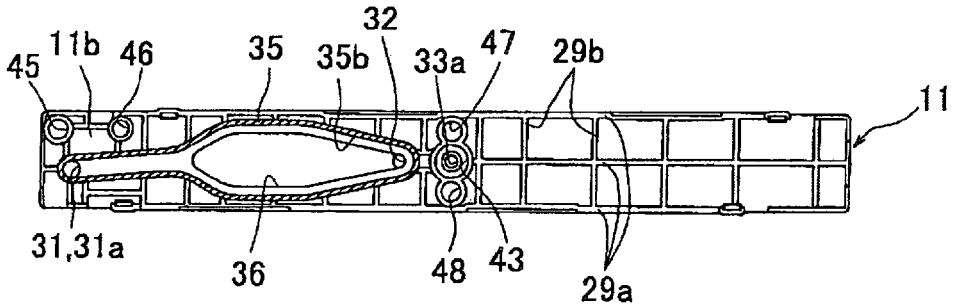
Figure 6:
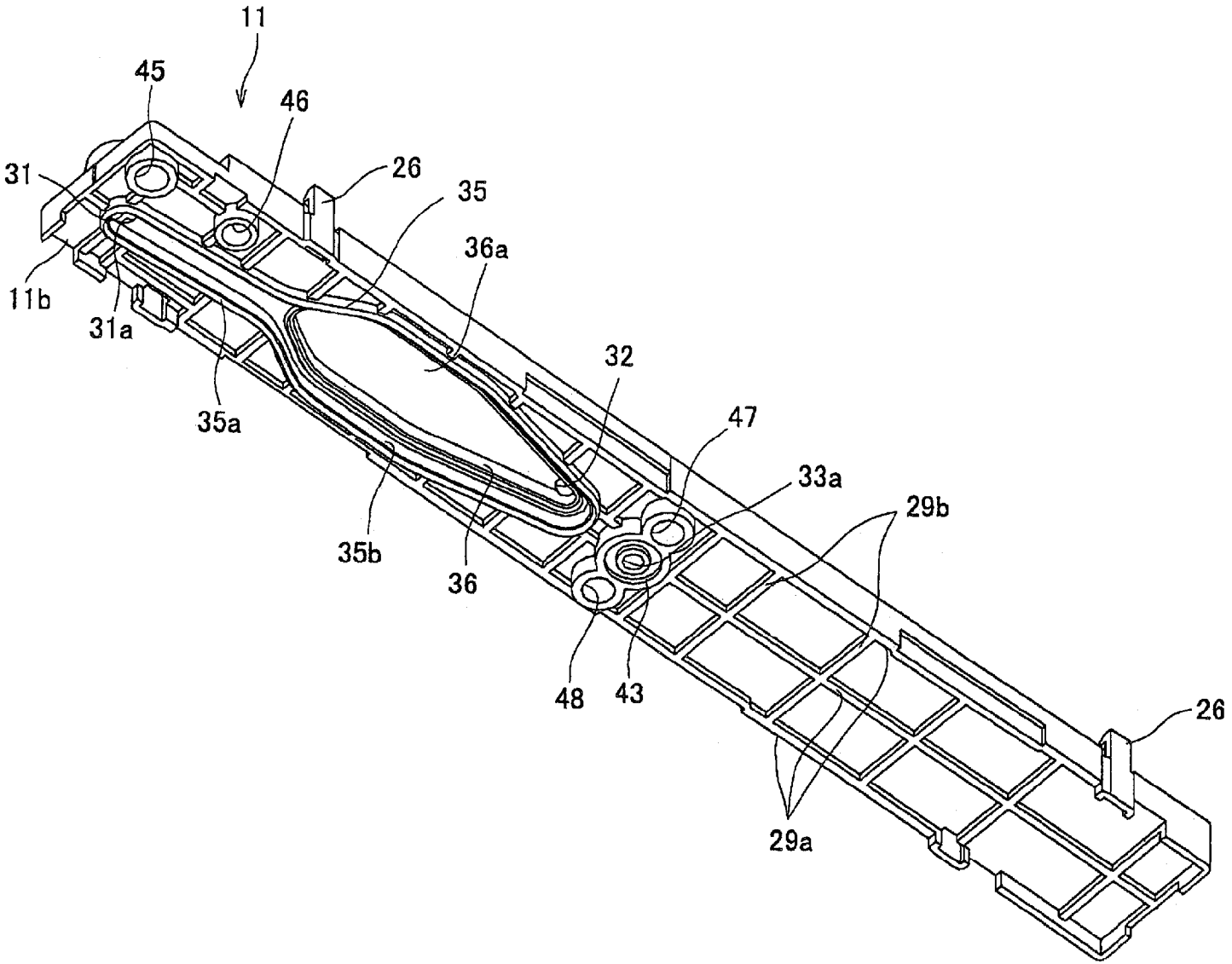
FIG. 6 is a perspective view of a passage component illustrated in FIG. 4 as obliquely viewed from downward.
Figure 7:
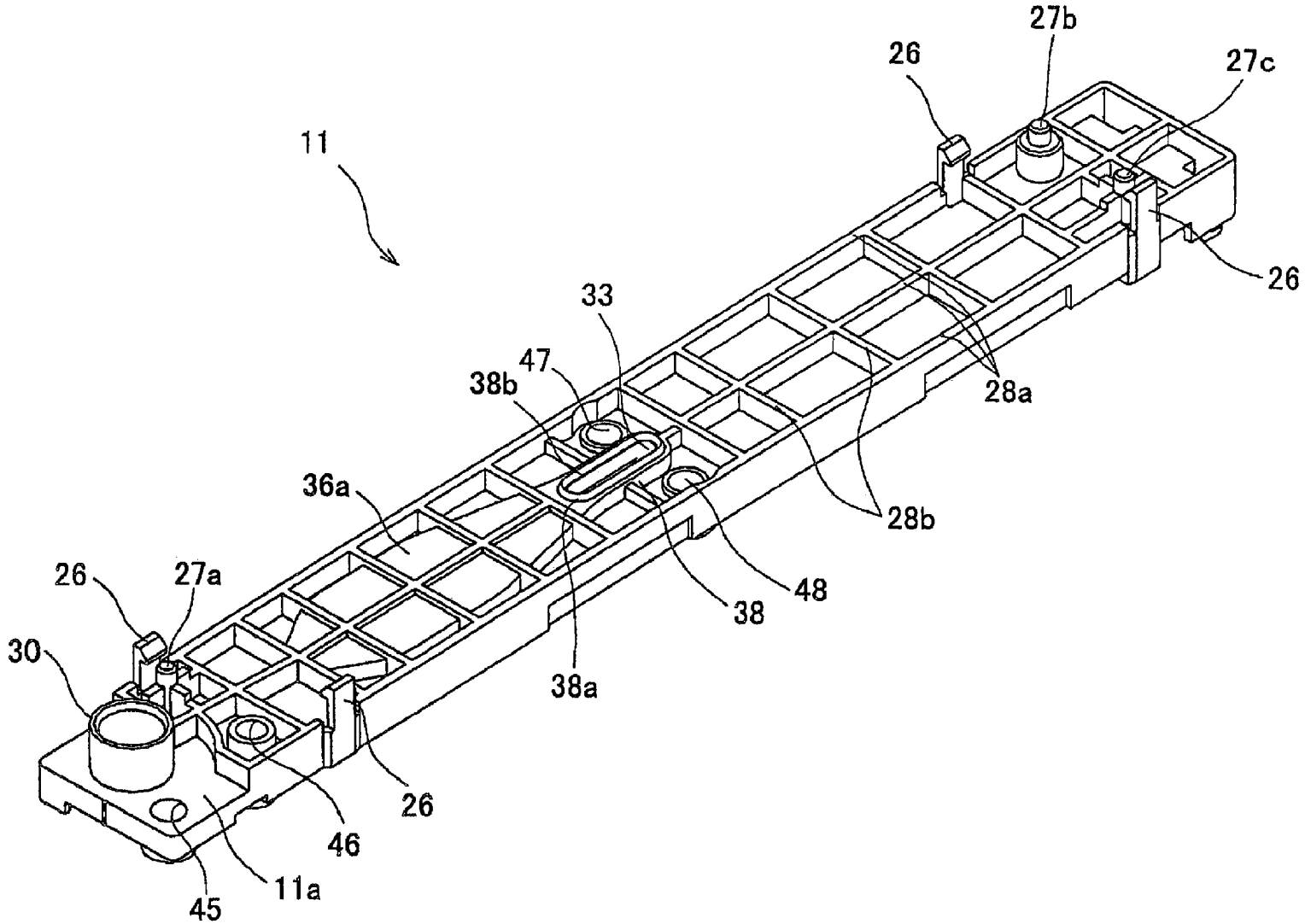
FIG. 7 is a perspective view of the passage component illustrated in FIG. 4 as obliquely viewed from upward.

FIG. 4 is a cross-sectional view of the reservoir unit 3 wherein cross-section thereof along the main scanning direction and up/down direction is illustrated. FIG. 5 is an exploded plan view of the reservoir unit illustrated in FIG. 2. FIG. 6 is a perspective view of the passage component illustrated in FIG. 4 as obliquely viewed from downward. FIG. 7 is a perspective view of the passage component illustrated in FIG. 4 as obliquely viewed from upward. In FIG. 2, for the convenience of explanation, perpendicularly upward scale is enlarged, and the ink passage in the reservoir unit 3, which is not generally depicted in sectional view taken along the same line, is properly illustrated. FIG. 5A is a view of the passage component 11 constituting a part of reservoir unit 3 as viewed from upside, and FIG. 5B is a view of the passage component 11 as viewed from downside. In FIGS. 5 to 7, for easy understanding of the structure of the passage component 11, films 41 and 42 and a filter 37, which will be described later, are omitted.

The reservoir unit 3 temporarily stores therein ink, and supplies ink to the passage unit 9 included in the head main body 2. As shown in FIGS. 4, and 5A to 5E, the reservoir unit 3 has a laminated structure in which the passage component 11 elongated in the main scanning direction, and three sheets of plates 12 to 14 each having a rectangular plane elongated in the main scanning direction are laminated. The three plates 12 to 14 are the metal plates such as, for example, stainless steel.

The uppermost passage component 11 is made of synthetic resin such as, for example, polyacetal resin or polypropylene resin, and, as shown in FIGS. 4 and 5A, an ink inlet hole 31 is provided in the vicinity of the longitudinal end of the passage component 11, and a communication port 32 and a communication hole 33 are provided near the longitudinally center of the passage component 11.

On the surface 11*a* of the passage component 11, a hollow type joint 30 is provided protruding upward from the vicinity of an inlet 31*a* of the ink inlet hole 31 while surrounding the inlet 31*a*. To the joint 30, a lower end of the ink supply valve 160 is connected. Thus, ink supplied from the ink supply valve 160 is supplied to the ink inlet hole 31 via the joint 30.

A number of ribs 28*a* and 28*b* protrude upward from the surface 11*a*. The ribs 28*a* extend in the main scanning direction and the ribs 28*b* extend in the sub scanning direction such that they are continuously integrated with each other. With the formation of the ribs 28*a* and 28*b* in the passage component 11, the passage component 11 is increased in its rigidity.

As shown in FIGS. 5B and 6, on a under face 11*b* of the passage component 11, an annular protrusion 35 is provided protruding downward from the under face 11*b* while surrounding the ink inlet hole 31 and the communication port 32. The annular protrusion 35 is open toward the plate 12. The annular protrusion 35 is so shaped in plan view as to extend in the main scanning direction from the ink inlet hole 31 to the communication port 32, and to enlarge, in the vicinity of the center of the annular protrusion, its width to the both ends thereof in the sub scanning direction, thereby forming a substantially oval shape.

At the end of the annular protrusion 35 in the protruding direction, as shown in FIG. 6, a pointed taper 35*a* is formed. The taper 35*a* is heated and fused beyond a film 41, being hot-melted with the film 41. The hot-melted area is illustrated in oblique lines shown in the left side of FIG. 5B. Thus, the substantially oval shaped opening 35*b* of the annular protrusion 35 is sealed.

Inside the annular protrusion 35 on the under face 11*b*, a concave section 36 is formed. As shown in FIG. 5B, the concave section 36 is so formed as to extend in the main scanning direction from the ink inlet hole 31, and to extend from a position starting expanding in the sub scanning direction to the communication port 32. The planar shape of the concave section 36 is somewhat smaller than the contour of the annular protrusion 35 formed from a point starting expanding in the sub scanning direction to the communication port 32, and is similar to that annular protrusion 35.

In the under face 11*b*, as shown in FIG. 4, a filter 37 having a number of micro holes, through which ink passes, is disposed so as to cover the concave section 36. The filter 37 is fixed in the vicinity of the edge of the concave section 36, and, as viewed from straight upside, is surrounded by the annular protrusion 35. That is, in plan view, the filter 37 is included in the opening 35*b*. Thus, it is easy to fix the filter 37 in the vicinity of the edge of the concave section 36 before the opening 35*b* is sealed by the film 41.

Also on the under face 11*b*, a number of ribs 29*a* and 29*b* similar to the ribs 28*a* and 28*b* are formed. The ribs 29*a* and 29*b* make the rigidity of the passage component 11 stronger. In addition, a bottom face 36*a* of the concave section 36, as shown in FIG. 7, protrudes upward from the surface 11*a*.

On the surface 11*a*, as shown in FIGS. 5A and 7, an annular protrusion 38 is formed protruding from the surface 11*a* while surrounding the communication port 32 and the communication hole 33. The end of the annular protrusion 38 in close proximity to the ink inlet hole 31 is integrated with the bottom face 36*a* of the concave section 36. The annular protrusion 38 has a substantially oval shape in plan view, extending in the main scanning direction.

Also in the end of the annular protrusion 38 in the protruding direction, as shown in FIG. 7, a taper 38*a* identical to that of the annular protrusion 35 is formed. The taper 38*a* is heated and fused beyond a film 42, being hot-melted with the film 42. The hot-melted area is illustrated in oblique lines shown in the center of the passage component 11 in the main scanning direction in FIG. 5A. Thus, the substantially oval shaped opening 38*b* of the annular protrusion 38 is sealed.

On each outer face at both ends of the passage component 11 in the sub scanning direction, as shown in FIGS. 5A and 7, two engaging clamps 26 are provided protruding upward from the rib 28*a*. The engaging clamps 26 grip and hold the upper face of the board 4 when the board 4 is disposed on the passage component 11.

On the surface 11*a*, a projection 27*a* near the joint 30, and two projections 27*b* and 27*c* near the end of the passage component 11 opposite to the joint 30 are formed. These projections 27*a* to 27*c* are fitted into through-holes formed on the board 4 when the board 4 is disposed on the passage component 11. That is, the projections 27*a* to 27*c* are for positioning between the passage component 11 and the board 4.

Like above, the passage component 11 is provided with the ink passage 34 extending from the inlet 31*a* of the ink inlet hole 31 to an outlet 33*a* of the communication hole 33, which passage is formed by the film sealing the opening 35*b* and the film 42 sealing the opening 38*b*. As shown in FIG. 4, the ink passage 34 extends downward from the inlet 31*a* and horizontally to the area confronting the filter 37. That is, the ink inlet hole 31 communicates with a passage extending from the film 41 to the filter 37. The passage then extends from the communication port 32 to the outlet 33*a* of the communication hole 33 via the filter 37 and the area confronting the film 42. Thus, ink is supplied into the ink passage 34 from the inlet 31*a* of the ink inlet hole 31, and is discharged outside from the outlet 33*a* of the communication hole 33.

In the proximity of the outlet 33*a*, an annular groove 43 open downward is formed. Into the groove 43, as shown in FIG. 4, an O-ring 44 is fitted. In the passage component 11, as shown in FIGS. 5A and 5B, four through-holes 45 to 48 passing through the surface 11*a* and the under face 11*b* are formed. The through-hole 45 is formed in the end side proximal to the ink inlet hole 31 of the passage component 11, the through-hole 46 is formed near the through-hole 45, and the through-holes 47 and 48 are formed at a position proximal to the communication hole 33.

The opening 38*b* of the annular protrusion 38 is formed smaller in area than the opening 35*b* of the annular protrusion 35. That is, the film 42 sealing the opening 38*b* has an area smaller than the film 41 sealing the opening 35*b*.

Figure 5C:
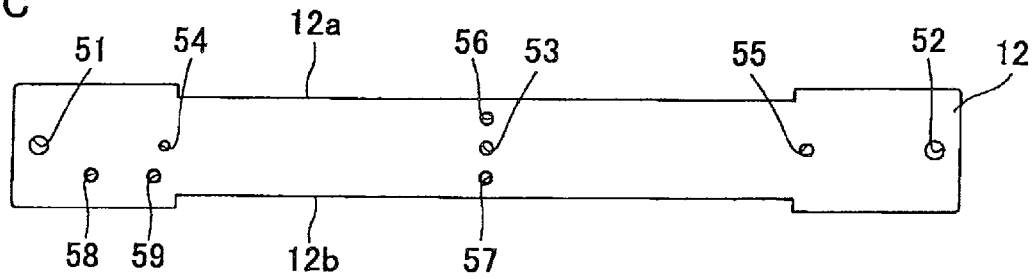

In the second-layered plate 12, as shown in FIGS. 4 and 5C, through-holes 51 and 52 are respectively formed at both ends thereof in the main scanning direction. These through-holes 51 and 52 are used for fixing the ink-jet head 1 to the printer main body by a screw. The plate 12 has a through-hole 53 at the center thereof and positioning holes 54 and 55 slightly close to the center of the plate from the through-holes 51 and 52, respectively.

The plate 12 has four screw holes 56 to 59. The screw holes 56 and 57 are formed at the center of the plate 12, and the screw holes 58 and 59 are formed in the vicinity of the left side of the plate 12 in FIG. 5C. The four screw holes 56 to 59 are formed corresponding to the four through-holes 45 to 48, so that when screws are threaded through the through-holes 45 to 48 and are fitted into the four screw holes 56 to 59, the passage component 11 and the plate 12 are fixed to each other. At this time, the through-hole 53 of the plate 12 confronts the communication hole 33 so that the through-hole 53 communicates with the ink passage 34. That is, the through-hole 53 is formed in the plate 12 as an ink passage 60 in the plate 12. Since the O-ring 44 is fitted into the annular groove 43 surrounding the outlet 33*a*, ink is prevented from leaking through a gap between the passage component 11 and the plate 12. A screw 25 threaded through the through-hole 46, as shown in FIG. 2, is also fitted into corresponding through-hole formed in the board 4, so that the screw fixes the board 4 and the passage component 11 together, as well as the passage component 11 and the plate 12 together.

At both ends of the plate 12 in the sub scanning direction, as shown in FIG. 5C, recesses 12*a* and 12*b* are formed which are reduced in width of the plate 12 in the sub scanning direction. A distance between bottom faces of the recesses 12*a* and 12*b*, i.e., a width of the plate 12 in the sub scanning direction where the recesses 12*a* and 12*b* are formed, is substantially equal to the width of the passage component 11 in the sub scanning direction. That is, the vicinity of the both ends of the plate 12 with respect to the main scanning direction has a width slightly larger than that of the passage component 11. The recesses 12*a* and 12*b* are the areas where the heat sinks 170 are disposed, and lengths thereof in the main scanning direction are exactly equal to, or slightly larger than the lengths of the heat sinks 170 in the main scanning direction.

Figure 5D:
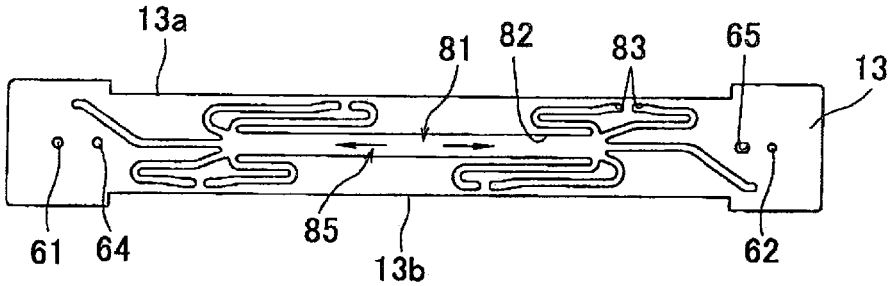

In the third layered plate 13, as shown in FIGS. 4 and 5D, a through-hole 81 is formed. The through-hole 81 defines a reservoir passage 85 including a main passage 82 and ten sub passages 83 communicating with the main passage.

The reservoir passage 85 has a planar shape that is point-symmetric with respect to the center of the plate 13. The main passage 82 extends longitudinally in the plate 13, and the center thereof corresponds to the through-hole 53 of the plate 12. The sub passages 83 have width smaller than the width of the main passage 82. The sub passages 83 all have the same widths and lengths, so that passage resistances among the respective sub passages 83 are substantially equal to one another.

The plate 13 has positioning holes 64 and 65 corresponding to the positioning holes 54 and 55, and through-holes 61 and 62. The through-holes 61 and 62 are the relief-holes that release the leading ends of the positioning pins upon mounting the reservoir unit 3 and the passage unit 9. At both ends of the plate 13 in the sub scanning direction, as shown in FIG. 5D, recesses 13*a* and 13*b* are formed which are reduced in width of the plate 13 in the sub scanning direction. These recesses 13*a* and 13*b* are formed at the areas overlapped with the recesses 12*a* and 12*b* when the plates 12 and 13 are laminated in order while the positioning holes 54 and 55 of the plate 12 and the positioning holes 64 and 65 of the plate 13 facing each other. That is, like the recesses 12*a* and 12*b*, the recesses 13*a* and 13*b* are the areas where the heat sinks 170 are disposed, and the lengths thereof in the main scanning direction are exactly equal to, or slightly larger than the lengths of the heat sinks 170 in the main scanning direction.

Figure 5E:
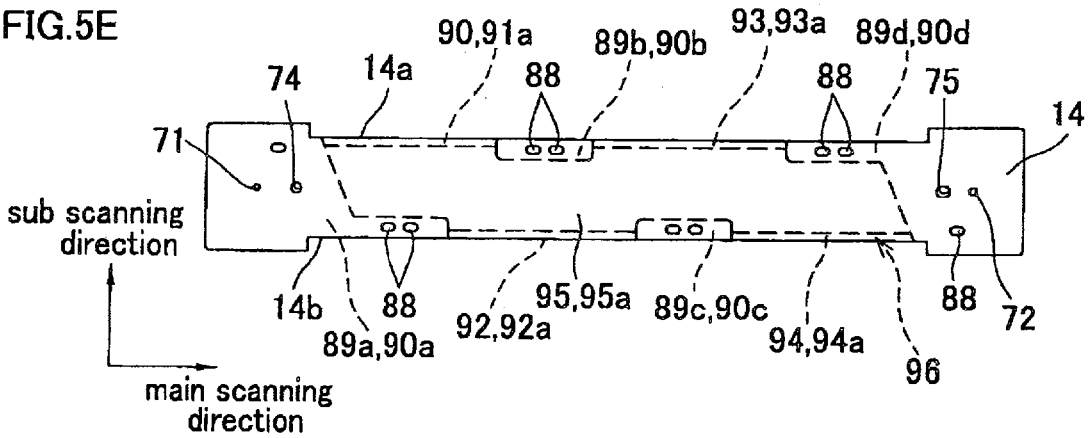

In the fourth layered plate 14, as shown in FIGS. 4 and 5E, four through-holes 71 to 75 and ten through-holes 88 are formed. The through-holes 71 and 72 are positioning holes for use in assembling the ink-jet head 1, particularly in mounting the reservoir unit 3 and the passage unit 9, and are disposed corresponding to the through-holes 61 and 62 of the plate 13. The through-holes 74 and 75 are positioning holes for use in laminating the plates of the reservoir unit 3, and are disposed corresponding to the positioning holes 64 and 65 of the plate 13. The ten through-holes 88 are ink supply holes 88 for supplying ink to the passage unit 9, and are formed confronting the leading ends of the sub passages 83 of the plate 13. The planar shape thereof is a substantially oval shape.

The present embodiment is characterized in that the plate 14 is divided into three regions. As shown in FIG. 5E, the three regions are fixed regions 89*a* to 89*d*, protrusion regions 91 to 94, and a spaced region 95. Upon assembling the ink-jet head 1, the fixed regions 89*a* to 89*d* are regions fixed onto the upper surface 9*a* of the passage unit 9. The protrusion regions 91 to 94 are regions confronting the upper surface 9*a* of the passage unit 9 and the FPC 6, and in which a draw-out section (confronting area) 6*b* of the FPC 6 is interposed between the upper surface 9*a* of the passage unit 9 and the protrusion regions 91 to 94. The spaced region 95 is a region spaced apart from the upper surface 9*a* of the passage unit 9.

The fixed regions 89*a* to 89*d* are an edge section of the ink supply hole 88, and include projections 89*a* to 89*d* protruding downward from a spaced face 95*a* to be described later. The fixed regions 89*a* and 89*d* are the projections 89*a* and 89*d* formed in the vicinity of the longitudinal end of the plate 14, and three ink supply holes 88 are disposed thereto. Four through-holes 71, 72, 74, and 75 are also disposed in those regions. The fixed regions 89*b* and 89*c* are the projections 89*b* and 89*c* formed at the ends in width direction of the plate 14, and these projections interpose the spaced region 95 therebetween, and two ink supply holes 88 are disposed in those regions, respectively.

The fixed regions 89*a* and 89*d* and the other regions 89*b* and 89*c* respectively have substantially identical shapes in plan view, and are disposed point-symmetrically with respect to the center of the plate 14 as a whole. The fixed faces 90*a* to 90*d* of the under faces of the fixed regions 89*a* to 89*d* are fixed to the upper surface 9*a* of the passage unit 9 and the filter (not shown) disposed on the upper surface 9*a*. In addition, the FPC 6 is drawn out between the neighboring fixed regions 89*a* to 89*d* in the main scanning direction.

The protrusion regions 91 to 94 all are the projections protruding downward from the ends in the width direction of a spaced face 95*a* of the plate 14. The protrusion regions 91 to 94 each extend in the main scanning direction, and connect the neighboring fixed regions 89*a* to 89*d*. In this embodiment, the protrusion regions 91 to 94 and the fixed regions 89*a* to 89*d* are formed in one piece, thereby constituting annular projections 96 arranged in one row in the outer edge of the plate 14. Widths of the protrusion regions 91 to 94 are smaller than those of the fixed regions 89*a* to 89*d* with respect to the sub scanning direction. The leading faces 91*a* to 94*a* of the protrusion regions 91 to 94 and the fixed faces 90*a* to 90*d* of the projections 89*a* to 89*d* are flush with each other, as shown in FIG. 3. That is, the protruding height of the fixed regions 89*a* to 89*d* from the spaced face 95*a* is substantially equal to the protruding height of the protrusion regions 90*a* to 90*d* from the spaced face 95*a*. The FPC 6 is drawn out so as to be interposed between the protrusion regions 91 to 94 and the passage unit 9. Herein, the protrusion regions 91 to 94 cross the FPC 6 in width direction thereof.

An irregular structure of the under face is formed at the same time by etching. Since it is not needed to construct the fixed regions 89*a* to 89*d* and the protrusion regions 91 to 94 with separate members, positioning accuracy for each member comes to be constant, and the reservoir unit 3 is easily fabricated.

The spaced region 95 is a region surrounded by the annular area 96. When the plate 14 is fixed to the passage unit 9, the spaced face 95*a* of the under face of the spaced region 95 confronts the upper surface 9*a* of the passage unit 9, forming a gap therebetween. In the gap, four actuator units 21 described later are disposed. Thus, the spaced region 95 has a size and a shape capable of receiving the four actuator units 21. The FPC 6 is overlapped in plan view with the protrusion regions 91 to 94 along its whole width. In the overlapped area of the FPC 6 with the actuator units 21, a slight gap still remains between the FPC 6 and the spaced region 95.

At both ends of the plate 14 in the sub scanning direction, as shown in FIG. 5E, recesses 14*a* and 14*b* are formed which are reduced in width of the plate 14 in the sub scanning direction. These recesses 14*a* and 14*b* are formed at the areas overlapped with the recesses 13*a* and 13*b* when the plates 13 and 14 are laminated in order while the positioning holes 64 and 65 of the plate 13 and the positioning holes 74 and 75 of the plate 14 facing each other. That is, like the recesses 13*a* and 13*b*, the recesses 14*a* and 14*b* are the areas where the heat sinks 170 are disposed, and the lengths thereof in the main scanning direction are exactly equal to, or slightly larger than the lengths of the heat sinks 170 in the main scanning direction.

These three plates 12 to 14 are positioned by inserting the positioning pins, which are not illustrated in the drawings, into the positioning holes 54, 55, 64, 65, 74, and 75. The plates then are fixed each other by an adhesive. Thus, the reservoir unit 3 is constituted in which the passage component 11 and the three plates 12 to 14 are laminated.

With the above construction, when the reservoir unit 3 is fixed to the passage unit 9, the four actuator units 21 and the FPC 6 thereof are positioned exactly in the gap space formed between the plate 14 and the upper surface 9*a* of the passage unit 9. Thus, ink hardly flows to the electric connection between the actuator units 21 and the FPC 6 from outside, thereby preventing electrical defects, such as a short.

Next, description will be made of the ink flowing in the reservoir unit 3. In FIG. 4, arrows indicate the ink flowing in the reservoir unit 3.

As indicated by the arrows in FIG. 4, ink introduced into the passage component 11 from the ink inlet hole 31 via the joint 30 flows horizontally along the film 41. Then, ink flows upward toward the filter 37 from the area confronting the filter 37, and passes through the communication port 32. Herein, since ink passes through the filter 37 from downside to upside, foreign particles contained in ink are caught by the filter 37, and when ink flowing is stopped, the caught particles drop down from the filter 37 and are spaced downward toward the film 41. Thus, the filter 37 is not blocked by the particles. Ink passing through the communication port 32 flows horizontally along the film 42, and when arriving at the communication hole 33, ink then flows downward. Ink discharged from the outlet 33*a* of the communication hole 33 then passes through the through-hole 53 and drops toward the reservoir passage 85.

Then, as indicated by the arrows in FIG. 5D, ink flows to both sides in the main scanning direction from the center of the main passage 82 along the longitudinal direction of the passage. When arrived at the both longitudinally ends of the main passage 82, ink diverges and is introduced into the respective sub passages 83. Ink introduced into the respective sub passages 83 passes through the ink supply hole 88 and filter (not shown) and is introduced into an ink supply hole 101 (See FIG. 8) formed in the upper surface 9*a* of the passage unit 9. Ink introduced into the passage unit 9, as described later, is distributed to a number of individual ink passages 132 communicating with a manifold passage 105. When arrived at nozzles 108 of end points of the respective individual ink passages 132, ink then is discharged outside. Like above, the ink passages such as the ink passage 34 and the reservoir passage 85 are formed in the reservoir unit 3, so that ink is temporarily stored therein.

Figure 8:
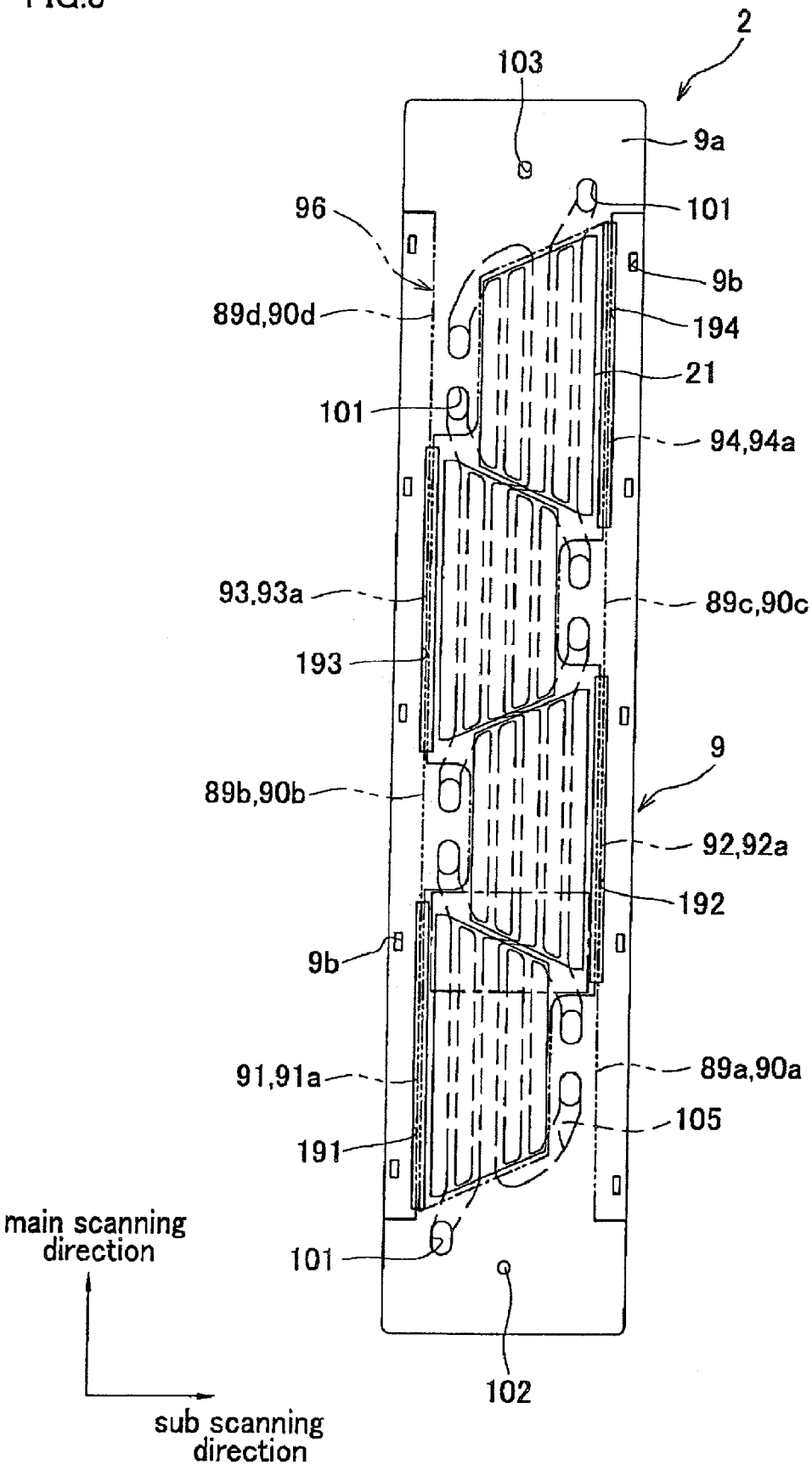
FIG. 8 is a plan view of a head main body.
Figure 9:
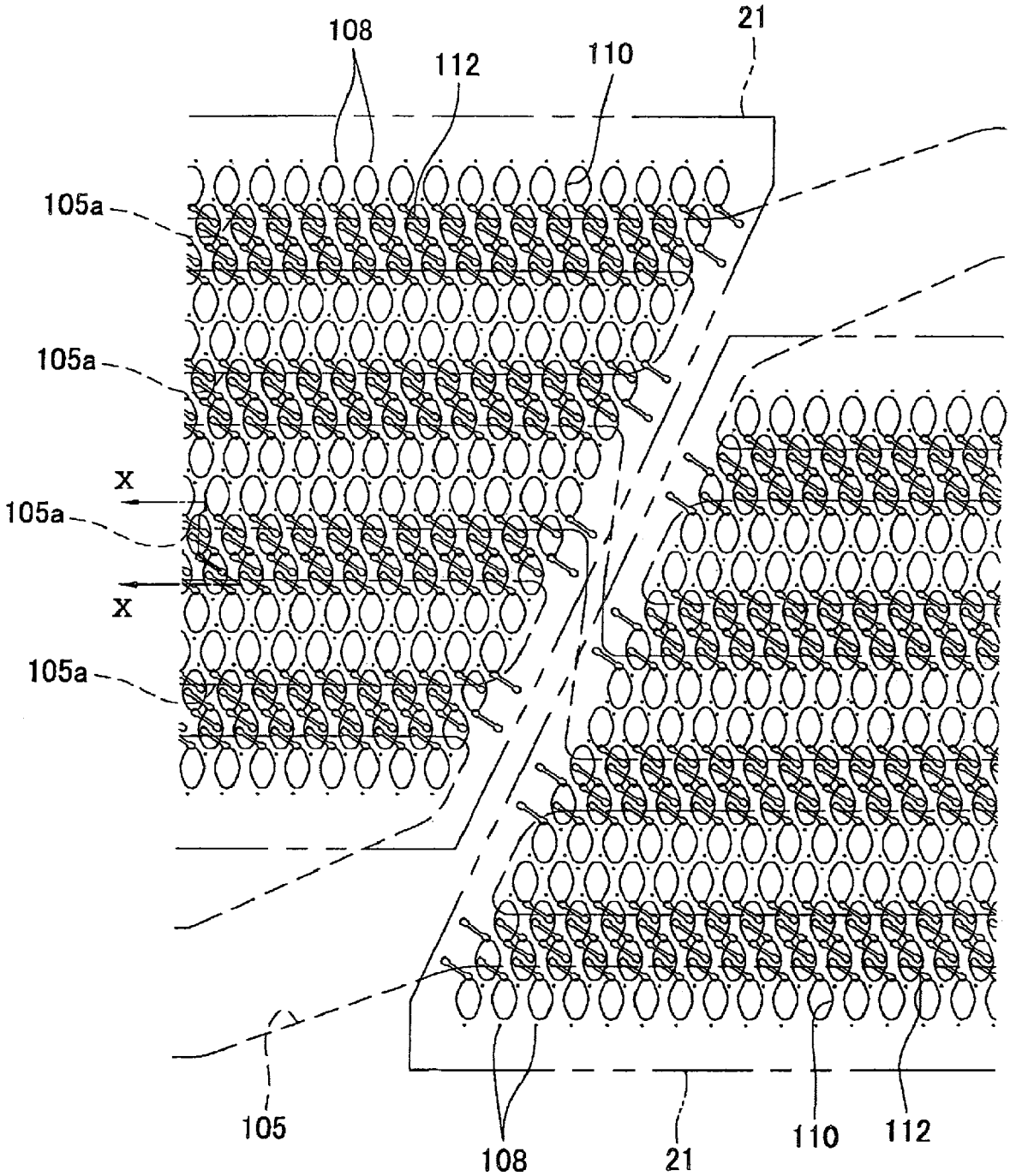
FIG. 9 is an enlarged view of an area indicated by the dashed dotted line in FIG. 8.
Figure 10:
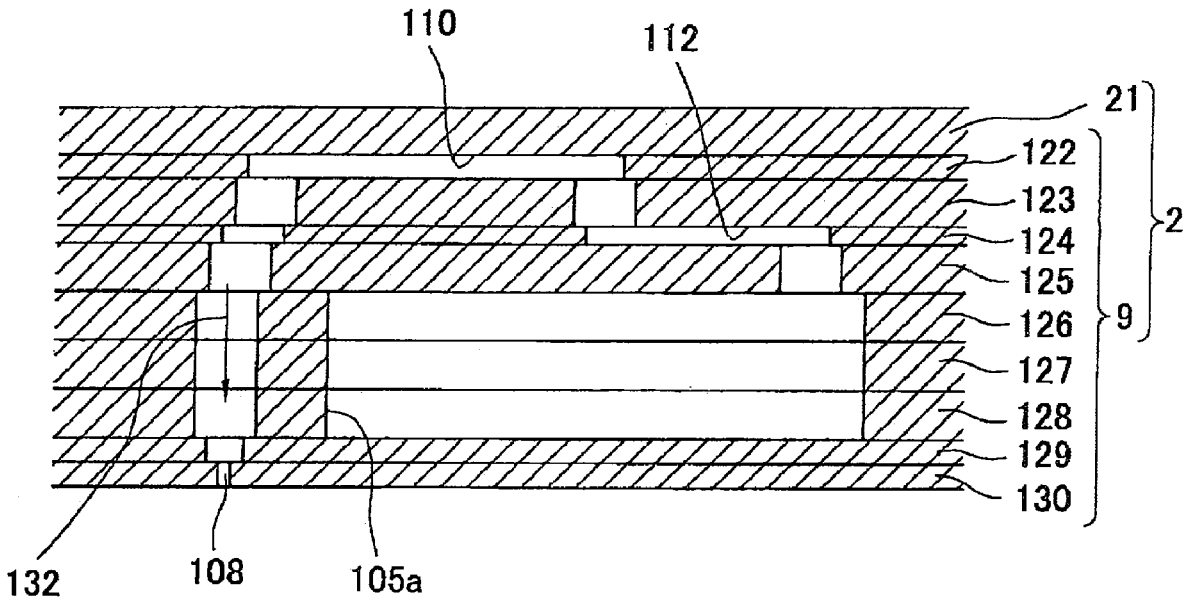
FIG. 10 is a partial sectional view taken along lines X-X illustrated in FIG. 9.
Figure 11A:
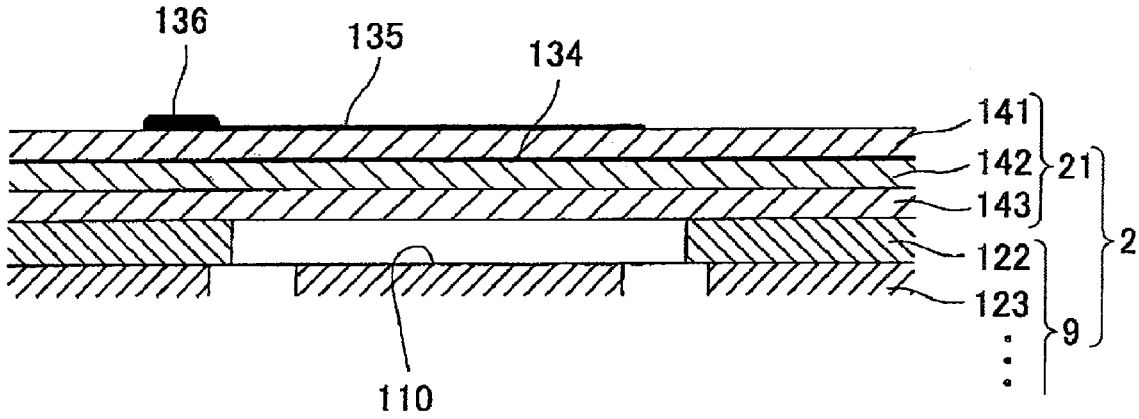
FIG. 11A is an enlarged sectional view of an actuator unit.
Figure 11B:
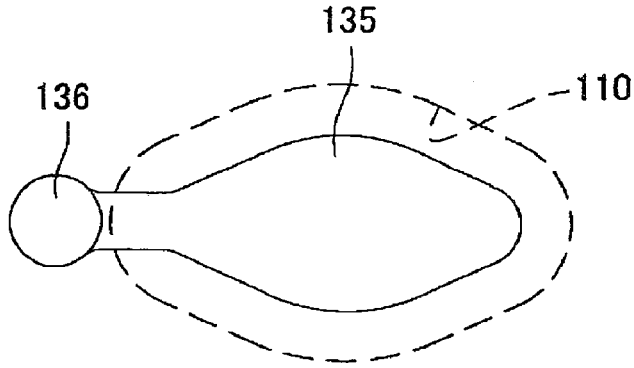
FIG. 11B is a plan view illustrating individual electrodes disposed on the surface of the actuator unit in FIG. 11A.

Next, the head main body 2 will be explained referring to FIGS. 8 to 11. FIG. 8 is a plan view of the head main body, and FIG. 9 is an enlarged view of an area indicated by the dashed dotted line in FIG. 8. In FIG. 9, while pressure chambers 110, apertures 112, and nozzles 108 should have been depicted by using a dotted line because they are positioned under the actuator unit 21, for the convenience of explanation, they are depicted by using a solid line. FIG. 10 is a partial sectional view taken along lines X-X illustrated in FIG. 9. FIG. 11A is an enlarged sectional view of the actuator unit 21, and FIG. 11B is a plan view illustrating individual electrodes disposed on the surface of the actuator unit 21 in FIG. 11A.

As shown in FIG. 8, the head main body 2 includes the passage unit 9 and the four actuator units 21 fixed onto the upper surface 9*a* of the passage unit 9. The passage unit 9 is shaped like a rectangular parallelepiped, a planar shape of which is substantially identical to the plate 14 of the reservoir unit 9. On the under face of the passage unit 9, as shown in FIGS. 9 and 10, an ink discharging face is formed in which a number of nozzles 108 are arranged in matrix. Many pressure chambers 110 are also arranged in matrix, similar to the nozzles 108, on the fixed face between the passage unit 9 and the actuator unit 21.

At both longitudinal ends of the passage unit 9, positioning holes 102 and 103 are formed corresponding to the relief holes 61 and 62 and the positioning holes 71 and 72 formed in the plates 13 and 14. With insertion of positioning pins through the relief holes 61 and 62 and the positioning holes 71, 72, 102 and 103, the passage unit 9 and the reservoir unit 3 are positioned.

On the upper surface 9*a* of the passage unit 9, as shown in FIG. 8, five recesses 9*b* are provided to both ends, respectively, of the passage unit 9 in the sub scanning direction along the main scanning direction. The ten recesses 9*b* in total are shaped such that the heat sinks 170 and the projections 172 are exactly fitted thereto. The recesses 9*b* are the area excluding the region where the fixed faces 90*a* to 90*d* (indicated by an alternated long and two short dashes line in the drawing) of the projections 89*a* to 89*d* of the plate 14 on the upper surface 9*a* of the passage unit 9 and the actuator units 21 are fixed, and as viewed from straight upside, the recesses 9*b* are formed at the area existing in the recesses 12*a*, 12*b*, 13*a*, 13*b*, 14*a*, and 14*b*.

On the upper surface 9*a* of the passage unit 9, as shown in FIG. 8, four recesses 191 to 194 open upward are provided. The recesses 191 to 194 each extend along the outer edge of the passage unit 9, and are disposed in parallel with each other. The recesses 191 to 194 extend in the main scanning direction, and the lengths thereof are larger than the length the long side of the actuator unit 21. The recesses 191 to 194 confront the projections 91 to 94 of the plat 14, and the widths thereof in the sub scanning direction are larger than the leading faces 91*a* to 94*a* of the projections 91 to 94. As viewed from straight upside, the projections 91 to 94 corresponding to the respective recesses 191 to 194 are disposed such that their centers coincide with each other. That is, the four recesses 191 to 194 are so overlapped with the respective leading faces 91*a* to 94*a* as to include therein them. Meanwhile, the recesses 191 to 194 consist of several through-holes formed in one ore more plates constituting the passage unit 9. In this embodiment, the recesses 191 to 194 are formed with through-holes of a cavity plate 122 to be described later.

As described above, the recesses 191 to 194 are wider than the leading faces 91*a* to 94*a*, and centerlines thereof in an extension direction coincide with each other. Thus, as viewed from straight upside, the recesses 191 to 194 are provided such that the central section thereof are blocked by the leading faces 91*a* to 94*a*, and both ends thereof with respect to the sub scanning direction are partially exposed outside to form an opening. That is, with respect to the sub scanning direction, i.e. draw-out direction of the FPC 6, both ends of the leading faces 91*a* to 94*a* are interposed between the both ends of the recesses 191 to 194. The openings have sizes and shapes substantially identical to each other. A width of the opening is several times the thickness of the FPC 6. Meanwhile, as shown in FIG. 3, the leading faces 91*a* to 94*a* are substantially flush with the upper surface 9*a* of the passage unit 9, so that they are spaced apart from inner faces of the recesses 191 to 194.

With the above construction, the FPC 6 is drawing out while crossing the protrusion regions 91 to 94 and the recesses 191 to 194, respectively. A draw-out direction of the FPC 6 is an extension direction of the wirings 6*a*, i.e., a sub scanning direction. The protrusion regions 91 to 94 and the recesses 191 to 194 are overlapped with the draw-out section 6*b* of the FPC 6 across the whole width thereof. After drawn out, the FPC 6 extends upward along the side face of the reservoir unit 3, and then is connected to the connector 5*a* of the board 4 disposed on the reservoir unit 3.

At this time, since the leading faces 91*a* to 94*a* are flush with the fixed regions 89*a* to 89*d* fixed to the passage unit 9, i.e., the fixed faces 90*a* to 90*d* of the projections 89*a* to 89*d*, the FPC 6 is once drawn out downward from the actuator unit 21, i.e., toward the passage unit 9. As shown in FIG. 3, when crossing the leading faces 91*a* to 94*a*, the draw-out section 6*b* goes into the recesses 191 to 194 from the opening inside in the sub scanning direction, and is drawn out upward from the opening outside in the sub scanning direction. Like above, the draw-out section 6*b* is deformed downward in convex type in the vicinity of the protrusion regions 91 to 94 by the leading faces 91*a* to 94*a*.

In such configuration, when the FPC 6 is held up to the board 4, or after held up, when an external force is suddenly applied, the force applied to the FPC 6 is divided into a first partial force drawing the FPC 6 in a face direction of the actuator unit 21 and a second partial force drawing the FPC 6 downward perpendicular to the face. However, any partial force does not operate in a direction that the FPC 6 and the actuator unit 21 are far away from each other.

As shown in FIG. 10, the passage unit 9 consists of nine metal plates including a cavity plate 122, a base plate 123, an aperture plate 124, a supply plate 125, manifold plates 126, 127, and 128, a cover plate 129, and a nozzle plate 130, which are disposed in the order named from upside. These plates 122 to 130 each have a rectangular planar shape that is long in the main scanning direction.

The cavity plate 122 is provided with through-holes corresponding to the ink supply hole 101 (See FIG. 8), through-holes that become the recesses 191 to 194, and substantially rhombic through-holes corresponding to the pressure chambers 110. The base plate 123 is provided with a connection hole between the pressure chamber 110 and the aperture 112 and a connection hole between the pressure chamber 110 and the nozzle 108 with respect to the respective pressure chambers 110, and a connection hole between the ink supply hole 101 and the manifold passage 105. The aperture plate 124 is provided with a through-hole coming to the aperture 112 and a connection hole between the pressure chamber 110 and the nozzle 108 with respect to the respective chambers 110, and a connection hole between the ink supply hole 101 and the manifold passage 105. The supply plate 125 is provided with a connection hole between the aperture 112 and the sub manifold passage 105*a* and a connection hole between the pressure chamber 110 and the nozzle 108 with respect to the respective pressure chambers 110, and a connection hole between the ink supply hole 101 and the manifold passage 105. The manifold plates 126, 127, and 128 are provided with a connection hole between the pressure chamber 110 and the nozzle 108 with respect to the respective pressure chambers 110, and through-holes connected with each other upon lamination to form the manifold passage 105 and the sub manifold passage 105*a*. The cover plate 129 is provided with a connection hole between the pressure chamber 110 and the nozzle 108 with respect to the respective pressure chambers 110. The nozzle plate 130 is provided with an opening corresponding to the nozzle 108 with respect to the respective pressure chambers 110. The eight plates 122 to 129 other than the nozzle plate 130 among the nine plates 122 to 130 each are provided with ten through-holes at a position of the formation of the recess 9*b*. These through-holes are overlapped and laminated as viewed from straight upside, so that on the upper surface 9*a*, ten open recesses 9*b* are formed in the passage unit 9.

These nine plates 122 to 130 are fixed to each other while being positioned and laminated such that the individual ink passage 132 as illustrated in the FIG. 10 is formed in the passage unit 9. In the present embodiment, similar to the plates 12 to 14 of the reservoir unit 3, the respective plates 122 to 130 are made of SUS430.

Returning to FIG. 8, on the upper surface 9*a* of the passage unit 9, total ten ink supply holes 101 are opened corresponding to the ink supply hole 88 (See FIG. 5E) of the reservoir unit 3. In the passage unit 9, the manifold passage 105 communicating with the ink supply hole 101 and the sub manifold passage 105*a* diverging from the manifold passage 105 are formed. With respect to the respective nozzles 108, as shown in FIG. 10, an individual ink passage 132 extending from the manifold passage 105 to the nozzle 108 via the sub manifold passage 105*a* and the pressure chamber 110 is formed. Ink supplied from the reservoir unit 3 into the passage unit 9 via the ink supply hole 101 diverges from the manifold passage 105 into the sub manifold passage 105*a*, and flows to the nozzle 108 via the aperture 112 functioning as a throttle, and the pressure chamber 110.

The four actuator units 21, as shown in FIG. 8, are arranged in zigzags so as to turn aside the ink supply hole 101 and the recesses 9*b*, and 191 to 194 opened in the upper surface 9*a* of the passage unit 9. The ink discharging face is positioned on the under face of the passage unit 9 corresponding to the adhesion area of the actuator unit 21. That is, the ink discharging face in which nozzles 108 are open in matrix, and the upper surface 9*a* in which the pressure chambers 110 are arranged in matrix constitute a pair of opposite parallel faces of the passage unit 9, between which many individual ink passages 132 are formed in the passage unit 9. In addition, the parallel opposed sides of the respective actuator units 21 follow the longitudinal direction of the passage unit 9, and the oblique sides of the neighboring actuator units 21 are overlapped with each other with respect to the width direction i.e. sub scanning direction of the passage unit 9. The four actuator units 21 have a relative positioning relation of being spaced opposite to each other in regular intervals from the center of the width direction of the passage unit 9.

The actuator unit 21, as shown in FIG. 11A, consists of three piezoelectric sheets 141, 142, and 143 each being made of ferroelectric PZT based ceramics material and having a thickness of approximately 15 micrometer. The piezoelectric sheets 141 to 143 are arranged over the pressure chambers 110 formed corresponding to a single ink discharging face.

In a position corresponding to the pressure chambers 110 on the uppermost piezoelectric sheet 141, the individual electrodes 135 are formed. Between the uppermost piezoelectric sheet 141 and the next layered piezoelectric sheet 142, a common electrode 134 formed in thickness of approximately 2 micrometer on the whole face of the sheet is interposed. The individual electrode 135 and the common electrode 134 all are made of metallic material such as, for example, Ag—Pd based material. An electrode is not disposed between the piezoelectric sheets 142 and 143.

The individual electrode 135 has a thickness of approximately 1 micrometer, and, as shown in FIG. 11B, has a substantially rhombic shape in plan view, similar to the pressure chamber 110. An acute section of the substantially rhombic individual electrode 135 extends for its one end, the leading end of which is installed with a circular land 136 having a diameter of approximately 160 micrometer and connected with the individual electrode 135. The land 136 is made of gold containing, for example, glass flit. As shown in FIG. 11A, the land 136 is formed at a position that is on the extension of the individual electrode 135, and confronts a wall partitioning the pressure chambers 110 of the cavity plate 122 with respect to the thickness direction of the piezoelectric sheets 141 to 143, i.e., a position that is on the extension of the individual electrode, and is not overlapped with the pressure chamber 110. The land is electrically connected with the wirings 6*a* of the FPC 6 (See FIG. 2).

The common electrode 134 is earthed to an area that is not shown. Thus, the common electrode 134 is kept at ground potential in the area corresponding to all pressure chambers 110. Meanwhile, the individual electrode 135 is connected to the driver IC 7 via the FPC 6, in which a wiring 6*a* is independently included in each land 136, and the land 136, so as to selectively control electro-potential.

Hereinafter, a driving method of the actuator unit 21 will be explained. The piezoelectric sheet 141 is polarized in its thickness direction. When an electric field is applied to the piezoelectric sheet 141 in its polarization direction while applying potential to the individual electrode 135 differently from the common electrode 134, the section in the piezoelectric sheet 141 where the electric field is applied serves as an active layer that is distorted by piezoelectric effect. That is, the piezoelectric sheet 141 expands or contracts in its thickness direction, and expands or contracts in a planar direction by piezoelectric transverse effect. Meanwhile, the other two piezoelectric sheets 142 and 143 are an inactive layer that does not have an area interposed between the individual electrode 135 and the common electrode 134, and are not spontaneously deformed.

That is, the actuator unit 21 is one in so called unimorph type in which one piezoelectric sheet 141 farthest from the pressure chamber 110 is a layer including an active layer, and two piezoelectric sheets 142 and 143 closer to the pressure chamber 110 are an inactive layer. As shown in FIG. 11A, since the piezoelectric sheets 141 to 143 are fixed onto the upper surface of the cavity plate 122 that partitions the pressure chamber 110, when distortion in a planar direction occurs between a section in the piezoelectric sheet 141 where the field is applied and the piezoelectric sheets 142 and 143 below the former sheet 141, the piezoelectric sheets 141 to 143 are so deformed (unimorph deformation) as to be convex toward the pressure chamber 110 as a whole. In such an actuator unit 21, the interposed section between the individual electrode 135 and the pressure chamber 110 comes to operate as an individual actuator, and a number of actuators are provided corresponding to the number of the pressure chambers 110.

Thus, the pressure chamber 110 is reduced in volume and a pressure in the pressure chamber 110 is raised, so that ink is drawn out from the pressure chamber 110 to the nozzle 108 and then is discharged outside from the nozzle 108. Then, when the individual electrode 135 returns to electro-potential equal to the common electrode 134, the piezoelectric sheets 141 to 143 return to their original flat shape, and the pressure chamber 110 also returns to its original volume. Thus, ink is introduced into the pressure chamber 110 from the manifold passage 105, and then is stored in the pressure chamber 110. With above process, desired images are printed on the paper.

In the ink-jet head 1 according to this embodiment, the draw-out section 6*b* of the FPC 6 drawn out from the actuator unit 21 enters the recesses 191 to 194 between the leading faces 91*a* to 94*a* and the inner faces of the recesses 191 to 194. Thus, for example, when the FPC 6 electrically connected to the actuator unit 21 is connected to the connector 5*a*, even though a tensile force is applied to the FPC 6, the draw-out section 6*b* comes to be drawn toward the upper face 9*a* and the bottom face of the recesses 191 to 194, so that it is difficult that a force is applied to the area where the wirings 6*a* of the FPC 6 confronting the actuator unit 21 and the individual electrode 135 are electrically connected such that the area moves upward far away from the actuator unit 21. Accordingly, the electrical connection between the wirings 6*a* and the individual electrode 135 is hardly disconnected.

Since the leading faces 91*a* to 94*a* of the projections 91 to 94 are overlapped with the draw-out section 6*b* across the overall width thereof, the draw-out section 6*b* enters the recesses 191 to 194 across the overall width thereof. Thus, even though a tensile force is applied to the FPC 6, the draw-out section 6*b* is regularly drawn out toward the upper surface 9*a* and the bottom face of the recesses 191 to 194 across its overall width. Accordingly, the connection between the wirings 6*a* and the individual electrode 135 is more hardly disconnected.

Since the plate 14 is provided with the projections 91 to 94 and the annular protrusion 96 continuous with the projections 89*a* to 89*d*, it is possible to form the projections 91 to 94 and the projections 89*a* to 89*d* at one time by using etching. Thus, these parts need not to be manufactured with space or individual parts, so that the plate 14 is easily made. In addition, since the fixed faces 90*a* to 90*d* and the leading faces 91*a* to 94*a* each are spaced in the same intervals from the spaced face 95*a*, upon the formation of the projections 91 to 94 and the projections 89*a* to 89*d*, it needs not to adjust the respective projection heights. Accordingly, the projections 89*a* to 89*d* and the projections 91 to 94 are more easily formed.

Figure 12A:
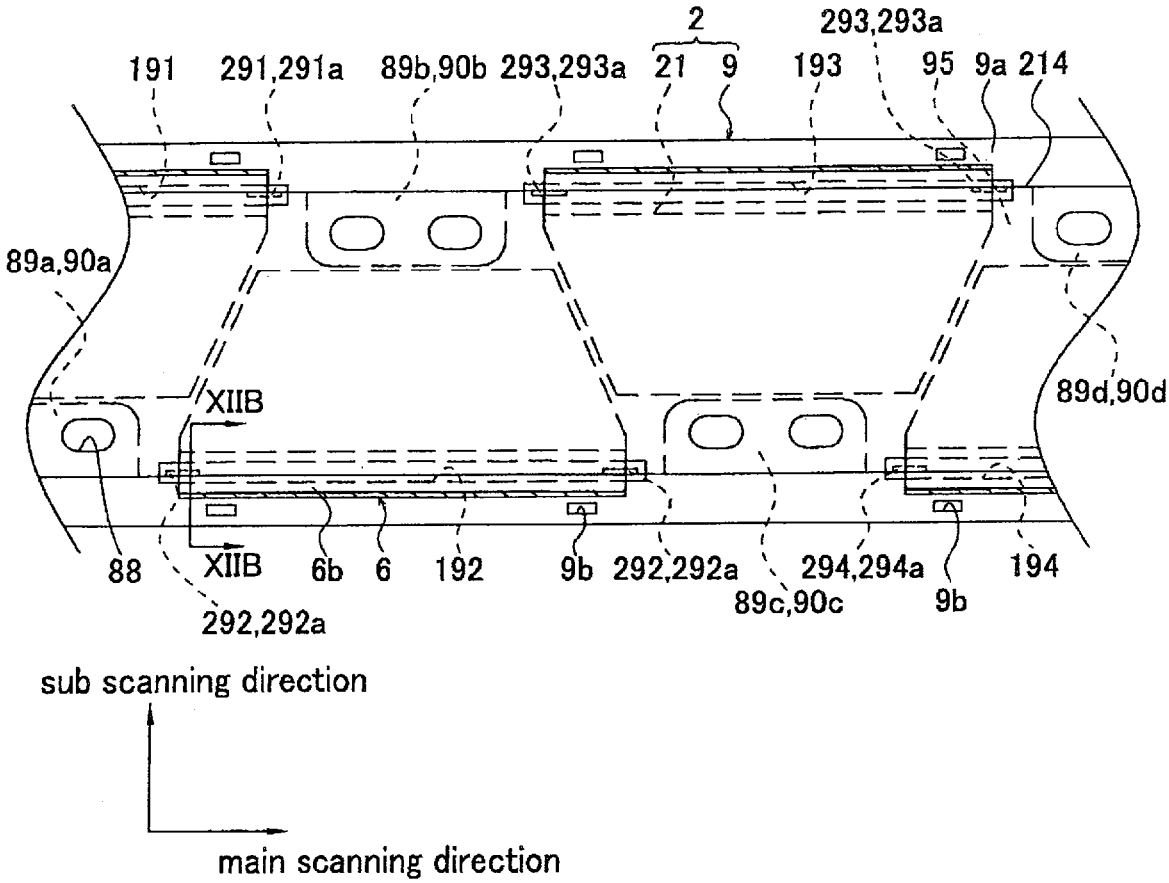
FIG. 12A is a plan view illustrating a head main body and a plate fixed to a passage unit of an ink-jet head according to a second embodiment of the present invention.
Figure 12B:
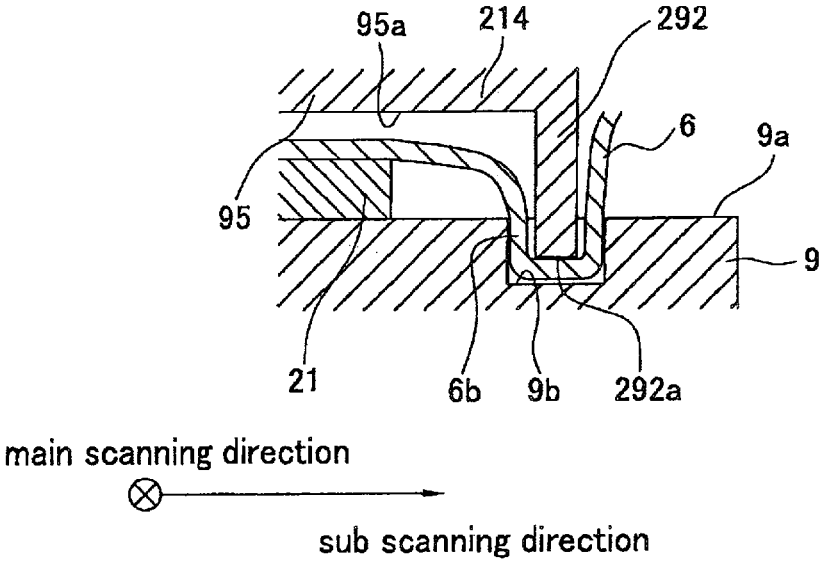
FIG. 12B is a partial sectional view taken along lines XIIB-XIIB illustrated in FIG. 12A.

Next, an ink-jet head according to a second embodiment of the invention will be explained. FIG. 12A is a plan view illustrating a head main body and a plate fixed to a passage unit of the ink-jet head according to the second embodiment, and FIG. 12B is a partial sectional view taken along lines XIIB-XIIB illustrated in FIG. 12A. In this embodiment, the ink-jet head has the same construction as in the first embodiment, except that, as shown in FIGS. 12A, 12B, a plate 214 fixed on the upper face 9*a* of the passage unit 9 is somewhat different from the plate 14. Those similar to the first embodiment are indicated by the same reference numerals, and description of which will be omitted.

Similar to the plate 14, the plate 214 disposed lowermost to constitute part of the reservoir unit is provided with ink supply holes 88, projections i.e. fixed regions 89*a* to 89*d*, and the fixed faces thereof 90*a* to 90*d*. The plate 214 is provided, on its under face, with four pairs of projections 291 to 294 that protrude perpendicular to the upper surface 9*a*, downward from a section between the projections 89*a* to 89*d* in the main scanning direction, i.e., downward from the plate 214. The pairs of projections 291 to 294 are respectively separated from each other in the main scanning direction, and in the vicinity of the projections 89*a* to 89*d*, are also separated from the projections 89*a* to 89*d*. For example, as shown in FIG. 12A, between the projections 89*a* and 89*c* in the main scanning direction, the pair of projections 292 are disposed, and between the projections 89*b* and 89*d*, the pair of projections 293 are disposed one projection 292 of the pair of projections 292 is disposed near the projection 89*a*, and the other projection 292 is disposed near the projection 89*c*. In addition, one projection 293 of the pair of projections 293 is disposed near the projection 89*b*, and the other projection 293 is disposed near the projection 89*d*. The pair of projections 291 to 294 have a planar shape of a rectangle extending in the main scanning direction, and are disposed at a position overlapped with the main scanning directional both ends of the draw-out section 6*b* of the FPC 6 drawn out from the actuator unit 21. In this embodiment, the pairs of projections 291 to 294 are formed when the projections 89*a* to 89*d* are formed on the plate 214 by etching. That is, the pairs of projections 291 to 294 are also formed in a single piece with the plate 214.

As shown in FIG. 12B, the pairs of projections 291 to 294 are spaced apart from the inner face of the recesses 191 to 194 because the leading faces thereof 291*a* to 294*a* are disposed near the center of the recesses 191 to 194. That is, in the leading faces 291*a* to 294*a*, the lengths of the leading faces 291*a* to 294*a* from the spaced face 95*a* with respect to the upward/downward directions perpendicular to the upper surface 9*a* is larger than that of the fixed faces 90*a* to 90*d* of the projections 89*a* to 89*d*. When the protruding lengths of the projections 291 to 294 from the spaced face 95*a* are larger than that of projections 89*a* to 89*d*, and the protrusions 291 to 294 enter the recesses 191 to 194, the draw-out section 6*b* of the FPC 6 is arranged closer to the bottom face of the recesses 191 to 194 as compared to the first embodiment. Thus, even though a tensile force is applied to the FPC 6, the draw-out section 6*b* is drawn out in a direction approaching the upper surface 9*a* and the bottom face of the recesses 191 to 194. Accordingly, the electrical connection between the wirings 6*a* and the individual electrode 135 is hardly disconnected.

At this time, the pairs of projections 291 to 294 are overlapped with the both ends of the draw-out section 6*b* in the main scanning direction, so that at least both ends of the draw-out section 6*b* is drawn out in a direction approaching the upper surface 9*a* and the bottom face of the recesses 191 to 194. Thus, in the area of the FPC 6 confronting the actuator unit 21, a force is not applied to the both ends of the draw-out section 6*b* in a direction upward far away from the actuator unit 21. Accordingly, the electrical connection between the wirings 6*a* and the individual electrode 135 is prevented from being disconnected from outside toward inside.

While the present invention has been described in connection with the above preferred embodiments, the invention is not limited thereto, but may be diversely changed without departing from the scope of the claims. For example, in the first embodiment, while the plate 14 is provided with the projections 91 to 94 overlapped with the recesses 191 to 194 throughout overall main scanning direction, the plate may be provided with one or more projections overlapped with an area except both ends of the recesses 191 to 194 in the main scanning direction. Even in this case, it is preferable that the projections be arranged to form an opening of the recess at both ends thereof in the sub scanning direction so as to allow the FPC to pass therethrough.

Figure 13A:
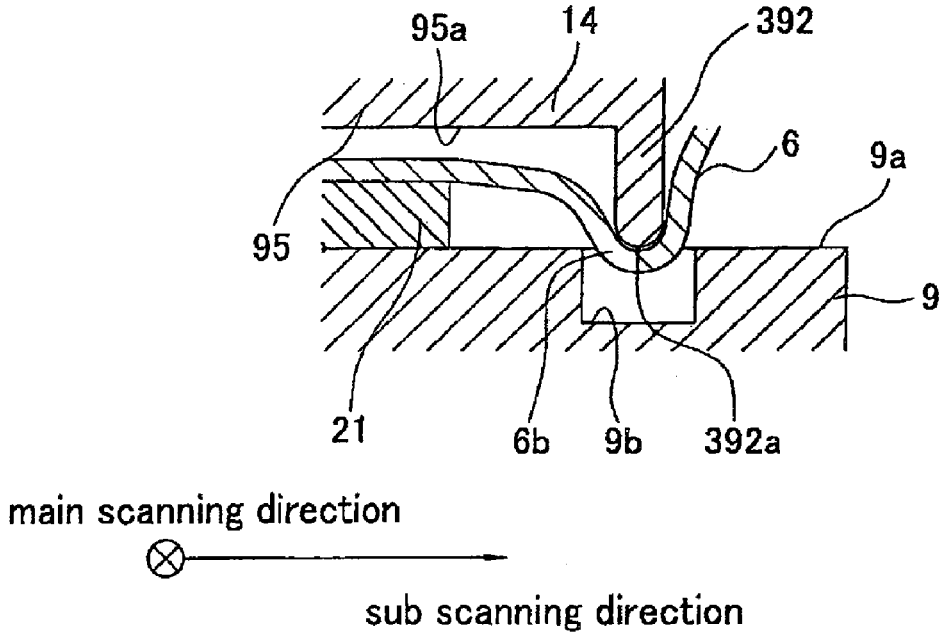
FIG. 13A is a partial sectional view corresponding to FIG. 12B when the projection is of a curved shape convex toward the bottom of the faces of the recesses in the first embodiment.
Figure 13B:
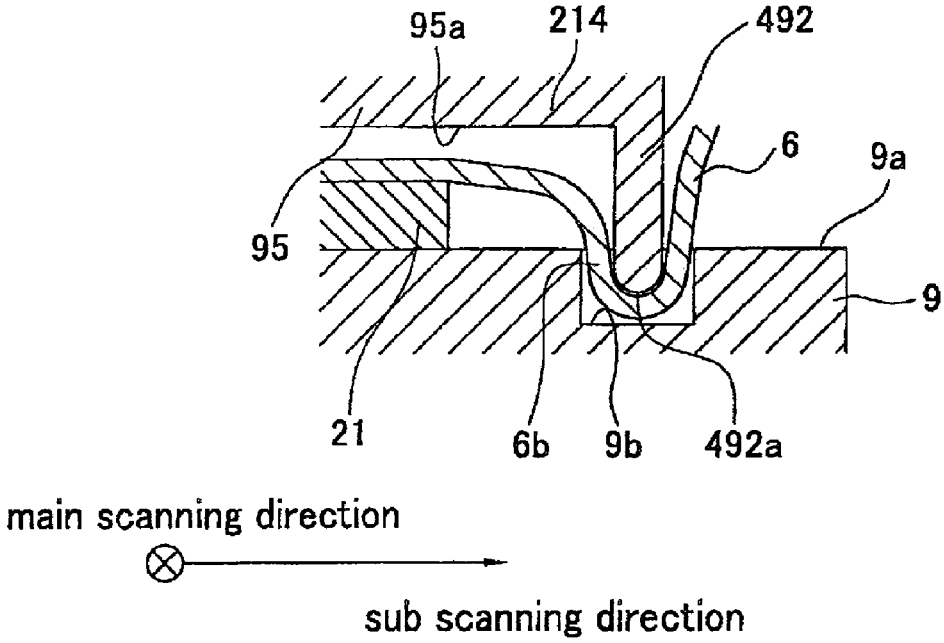
FIG. 13B is a partial sectional view corresponding to FIG. 12B when the projection is of a curved shape convex toward the bottom of the faces of the recesses in the second embodiment.

In the first and second embodiments, the leading faces of the projections 91 to 94 and 191 to 194 may be of a curved shape convex toward the bottom faces of the recesses, like the leading faces 391*a* to 394*a* as shown in FIG. 13A and the leading faces 491*a* to 494*a* as shown in FIG. 13B. Thus, the boundary between the side face and the leading face 391*a* to 394*a* and 491*a* to 494*a* of the projections 391 to 394 and 491 to 494 forms a smooth curve, so that even upon application of tensile force to the FPC, the FPC is prevented from being damaged by edges of the projections. Further, the boundary between the leading face and the side face of the projection may be R-machined. Also in this case, even upon application of tensile force to the FPC, the FPC is prevented from being damaged by edge of the projection.

In the first embodiment, while the annular protrusion 96 surrounding the four actuator units 21 at one time is configured by the projections 89*a* to 89*d* and the projections 91 to 94, it may be constructed such that projections are installed between neighboring actuator units 21, and annular projections, in which opposite projections, such as the projections 89*a* and 91, with respect to the sub scanning direction are continuous, are formed corresponding to the number of the actuator units.

Moreover, in any embodiment, in the vicinity of the opening outside in the sub scanning direction, the boundaries between the draw-out section 6*b*, and the plate 14, 214 and the upper surface 9*a* of the passage unit 9, respectively, may be blocked by a sealant or an adhesive, which prevents ink intrusion from outside. Furthermore, the connection between the actuator unit 21 and the FPC 6 is hardly affected with direct external force due to the adhesive.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An ink-jet head comprising:

a passage unit that has a plurality of pressure chambers arranged along a plane and communicating with a plurality of ink ejection ports that are formed on an ink discharging face;

an actuator unit that is supported by a support face of the passage unit opposite to the ink discharging face, that has a plurality of individual electrodes each confronting the pressure chambers, and that changes in volume of the pressure chambers;

a flexible printed circuit that has a plurality of wirings which supply driving signals to the individual electrodes, and that is provided with a connection area where the respective wirings are electrically connected with corresponding individual electrodes and which confronts the actuator unit, and a confronting area continuous with the connection area and confronting not the actuator unit but the passage unit; and a covering that includes a spaced region, a fixed region, and a protrusion region, wherein the spaced region has a spaced face spaced apart from the connection area with respect to a direction perpendicular to the ink discharging face, the fixed region has a fixed face that protrudes toward the passage unit from the spaced face and is fixed to the support face as well, the protrusion region has a leading face that protrudes toward the passage unit from the spaced face, and the confronting area is interposed between the leading face and the passage unit;

wherein a protruding length of the protrusion region from the spaced face is equal or larger than that of the fixed region, wherein a recess is formed on the support face of the passage unit at a position confronting the leading face, wherein both ends of the leading face are interposed between both ends of the opening of the recess with respect to a draw-out direction that is parallel to the support face and is toward the confronting area from the connection area, wherein the protrusion region is spaced apart from an inner face of the recess, and wherein the confronting area of the flexible printed circuit passes through the recess.

2. The ink-jet head as claimed in claim 1, wherein the covering is provided with the one or more protrusion regions such that both ends of the flexible printed circuit with respect to a direction perpendicular to the draw-out direction in the confronting area respectively confront the leading face.

3. The ink-jet head as claimed in claim 2, wherein the confronting area of the flexible printed circuit passes through the recess across the overall width thereof.

4. The ink-jet head as claimed in claim 1, wherein one or more actuator units are supported on the support face, and the flexible printed circuit is connected to the respective actuator units, and wherein the protrusion region is continuous with at least one of the fixed region associated with corresponding actuator unit and the fixed region associated with an adjacent actuator unit, so that the covering is provided with an annular protrusion surrounding the one or more spaced region.

5. The ink-jet head as claimed in claim 1, wherein the protrusion region of the covering enters the recess together with the confronting area of the flexible printed circuit.

6. The ink-jet head as claimed in claim 1, wherein the leading face of the protrusion region is flush with the support face with respect to the direction perpendicular to the ink discharging face.

7. The ink-jet head as claimed in claim 1, wherein the leading face of the protrusion region is of a curved shape convex toward the inner face of the recess.

8. The ink-jet head as claimed in claim 1, wherein at least one of the boundary between the confronting area of the flexible printed circuit and the covering, and the boundary between the confronting area of the flexible printed circuit and the passage unit are blocked by a sealant.

9. The ink-jet head as claimed in claim 1, comprising a circuit board on the covering, wherein, the flexible printed circuit is connected to the actuator unit at one end, and drawn along a side of the covering, and connected to the board at the other end.

* * * * *